US011659859B2

(12) United States Patent
Jordil et al.

(10) Patent No.: US 11,659,859 B2
(45) Date of Patent: May 30, 2023

(54) SMOKING ARTICLE COMPRISING EXTINGUISHER ELEMENT

(71) Applicant: PHILIP MORRIS PRODUCTS S.A., Neuchatel (CH)

(72) Inventors: Yves Jordil, Neuchatel (CH); Alen Kadiric, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 268 days.

(21) Appl. No.: 16/771,931

(22) PCT Filed: Dec. 12, 2018

(86) PCT No.: PCT/EP2018/084592
§ 371 (c)(1),
(2) Date: Jun. 11, 2020

(87) PCT Pub. No.: WO2019/121250
PCT Pub. Date: Jun. 27, 2019

(65) Prior Publication Data

US 2020/0390146 A1 Dec. 17, 2020

(30) Foreign Application Priority Data

Dec. 18, 2017 (EP) ..... 17208218

(51) Int. Cl.
*A24D 1/10* (2006.01)
*A24D 1/04* (2006.01)

(52) U.S. Cl.
CPC ..... *A24D 1/10* (2013.01); *A24D 1/045* (2013.01)

(58) Field of Classification Search
CPC ..... A24D 1/10; A24D 3/0216; A24D 3/022
See application file for complete search history.

(56) References Cited

U.S. PATENT DOCUMENTS 4,226,249 A 10/1980 Newman
4,436,101 A 3/1984 Seatts
(Continued)

FOREIGN PATENT DOCUMENTS

CN 1 843 235 10/2006
FR 2 752 364 2/1998
(Continued)

OTHER PUBLICATIONS

Office Action issued in Russia for Application No. 2020121693 dated Nov. 24, 2021 (20 pages). English translation included.
(Continued)

*Primary Examiner* — Galen H Hauth
*Assistant Examiner* — Dionne W. Mayes
(74) *Attorney, Agent, or Firm* — Mueting Raasch Group

(57) ABSTRACT

A smoking article (10) includes a tobacco rod ("rod") (12) and a mouthpiece (14) secured to a downstream end of the rod (12). The mouthpiece contains: a tubular element (20) defining a longitudinal channel, a downstream segment of filter material (24), and an extinguisher element (22). The tubular element (20) is provided adjacent the downstream end of the rod (12). The downstream segment of filter material (24) is downstream of the tubular element (20) and spaced apart from the tubular element (20) to define a cavity (26) between the tubular element (20) and the downstream segment of filter material (24). The extinguisher element (22) includes: a compressible reservoir (28) provided in the cavity (26) and containing liquid, a neck portion (30) extending upstream from the reservoir (28) and having an open end, and a seal (32) provided over the open end of the neck portion (30). The neck portion (30) is received in the longitudinal channel of the tubular element (20) such that the open end is proximate the downstream end of the rod (12).

14 Claims, 1 Drawing Sheet

(56) References Cited

U.S. PATENT DOCUMENTS

Figure 1:
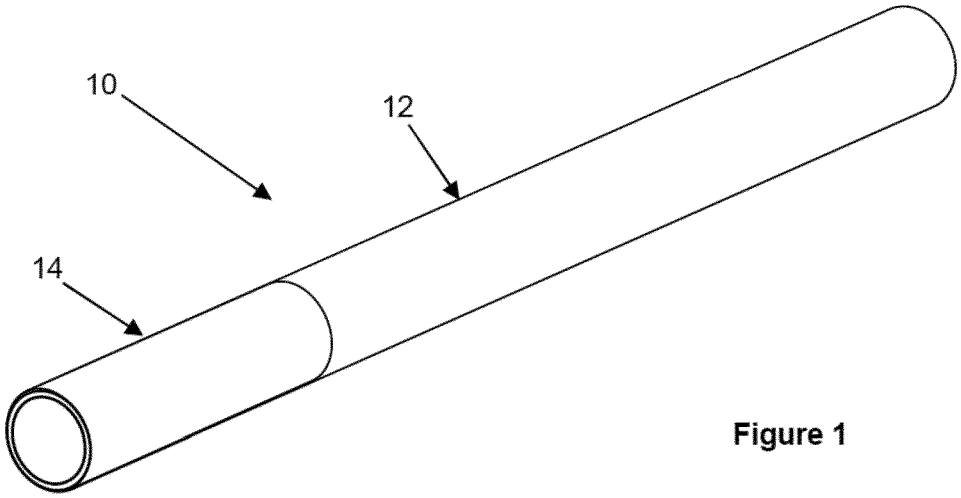

| | | | | |
|---|---|---|---|---|
| 5,595,195 | A | 1/1997 | Chang | |
| 2004/0074507 | A1* | 4/2004 | MacAdam et al. | A24D 3/14 131/337 |
| 2005/0268926 | A1 | 12/2005 | Hsu | |
| 2008/0173320 | A1* | 7/2008 | Dunlap | A24D 1/02 131/365 |
| 2011/0232659 | A1* | 9/2011 | Ercelebi | A24D 3/0225 29/458 |
| 2016/0242459 | A1 | 8/2016 | Deri | |

FOREIGN PATENT DOCUMENTS

| | | |
|---|---|---|
| RU | 2229253 | 5/2004 |
| RU | 2016113357 | 10/2017 |
| WO | WO 2013/178515 | 12/2013 |
| WO | WO 2015/068170 | 5/2015 |

OTHER PUBLICATIONS

PCT Search Report and Written Opinion for PCT/EP2018/084592 dated Mar. 11, 2019 (9 pages).

* cited by examiner

SMOKING ARTICLE COMPRISING EXTINGUISHER ELEMENT

This application is a U.S. National Stage Application of International Application No. PCT/EP2018/084592 filed Dec. 12, 2018, which was published in English on Jun. 27, 2019 as International Publication No. WO 2019/121250 A1. International Application No. PCT/EP2018/084592 claims priority to European Application No. 17208218.2 filed Dec. 18, 2017.

The present invention relates to a smoking article comprising an extinguisher element for delivering a liquid into the tobacco rod in order to extinguish the burning end of the tobacco rod after use.

Smoking articles, such as cigarettes, typically comprise an aerosol-generating substrate, such as a tobacco rod, attached to a mouthpiece. Conventional mouthpieces comprise one or more segments of a filtration material such as cellulose acetate tow. It is known to provide a reservoir of a liquid within a mouthpiece, wherein the liquid is releasable from the reservoir after smoking in order to extinguish the burning end of the tobacco rod. Typically, such reservoirs are formed with a frangible wall which breaks apart to release the liquid contained within the reservoir upon the application of a compressive force by the consumer.

In certain prior art examples, a reservoir containing a liquid is incorporated in the filter of a smoking article and an elongate tube is provided extending from the reservoir and through the tobacco rod. Upon compression of the reservoir, the liquid is released into the tube and delivered to the burning end of the tobacco rod in order to extinguish the smoking article. A smoking article including such an arrangement of a connected reservoir and elongate tube is typically very challenging to manufacture since the reservoir and elongate tube cannot be incorporated into the smoking article using conventional assembly apparatus and techniques. The components are relatively complex and difficult to insert into the smoking article, in particular since the connected reservoir and elongate tube typically extend between the filter and tobacco rod, which are typically formed separately and then combined.

It would therefore be desirable to provide a novel extinguisher means which can be incorporated into a smoking article in order to provide efficient extinguishment of a burning tobacco rod after use. It would be particularly desirable to provide such an extinguisher means which can be readily incorporated into existing smoking article constructions such that the smoking articles can be manufactured with minimal modification to existing high speed manufacturing machines and processes.

According to a first aspect of the present invention there is provided a smoking article comprising a tobacco rod and a mouthpiece secured to a downstream end of the tobacco rod, the mouthpiece comprising a mouthpiece including a tubular element defining a longitudinal channel, wherein the tubular element is provided adjacent the downstream end of the tobacco rod; a downstream segment of filter material, wherein the downstream segment of filter material is downstream of the tubular element and spaced apart from the tubular element to define a cavity between the tubular element and the downstream segment of filter material; and an extinguisher element. The extinguisher element comprises a compressible reservoir provided in the cavity between the tubular element and the downstream segment of filter material; a neck portion extending in a longitudinal direction upstream from the reservoir and having an open end; and sealing means provided over the open end of the neck portion. The neck portion is received in the longitudinal channel of the tubular element such that the open end is proximate the downstream end of the tobacco rod. The compressible reservoir contains a liquid. Upon compression of the reservoir during use, the sealing means over the open end of the neck portion are broken and the liquid from the reservoir is releasable through the neck portion directly into the tobacco rod.

According to a second aspect of the present invention, there is provided a mouthpiece for a smoking article, the mouthpiece comprising: a tubular element defining a longitudinal channel, wherein the tubular element is provided at an upstream end of the mouthpiece; a downstream segment of filter material, wherein the downstream segment of filter material is downstream of the tubular element and spaced apart from the tubular element to define a cavity between the tubular element and the downstream segment of filter material; and an extinguisher element. The extinguisher element comprises a compressible reservoir provided in the cavity between the tubular element and the downstream segment of filter material; a neck portion extending in a longitudinal direction upstream from the reservoir and having an open end; and sealing means provided over the open end of the neck portion. The neck portion is received in the longitudinal channel of the tubular element such that the open end is proximate the downstream end of the tobacco rod. The compressible reservoir contains a liquid. Upon compression of the reservoir during use, the sealing means over the open end of the neck portion are broken and the liquid from the reservoir is releasable through the neck portion directly into the tobacco rod.

According to a third aspect of the present invention there is provided a method of manufacturing a mouthpiece for a smoking article, the method comprising the steps of: providing a tubular element having a longitudinal channel; providing an extinguishing element comprising a compressible reservoir; a neck portion extending from the reservoir and having an open end; and sealing means provided over the open end of the neck portion; inserting the neck portion of the extinguishing element into the longitudinal channel of the tubular element; combining the tubular element with the extinguishing element inserted therein with a segment of filter material such that the reservoir of the extinguishing element is positioned between the tubular element and the segment of filter material; and circumscribing the tubular element, the extinguishing element and the segment of filter material with a wrapper to form a mouthpiece.

Any reference to the extinguisher element of the smoking article of the present invention should be considered to also apply to the extinguisher element of other aspects of the invention, unless stated otherwise.

As used herein, the terms “upstream” and “downstream” describe the relative positions of elements, or portions of elements, of the smoking article in relation to the direction in which a consumer draws on the smoking article during use thereof. Smoking articles as described herein comprise a downstream end, corresponding to the mouth end, and an opposed upstream end. In use, a consumer draws on the downstream end of the smoking article. The downstream end is downstream of the upstream end, which may also be described as the distal end.

As used herein, the term “extinguisher element” refers to a discrete mouthpiece element for the storage and delivery of a liquid within the smoking article. The extinguisher element of the present invention is configured to be activated by the consumer in order to release liquid to the tobacco rod. The extinguisher element therefore provides a novel and effective way for the consumer to extinguish the burning tobacco rod after use. The consumer is also provided with a choice over when to deliver the liquid to extinguish the smoking article so that the smoking article can be readily extinguished at any time during smoking.

In the mouthpiece arrangement of the present invention, the neck portion of the extinguisher element is supported in the tubular element and the neck portion is therefore protected during manufacture. This prevents the sealing means over the open end of the neck portion from being damaged or broken. Furthermore, it prevents the extinguisher element from being cut during any cutting of the mouthpiece components in the assembly process for producing the mouthpiece. In particular, the support of the neck portion of the extinguisher element in the tubular element additionally allows the open end of the neck portion to be placed towards the upstream end of the mouthpiece, in close proximity to the tobacco rod, without risk of being damaged or cut. This allows for fast and efficient extinguishment of the tobacco rod upon release of the liquid from the extinguisher element.

The extinguisher element is arranged with the neck portion supported into the tubular element such that the open end is directed towards the tobacco rod. The directionality of the liquid release from the extinguisher element is therefore controlled so that the liquid is released in an upstream direction, directly into the tobacco rod. This ensures that as much of the liquid as possible reaches the burning end of the tobacco rod, to optimise the extinguishment of the tobacco rod.

The combined tubular element and extinguisher element, with the neck portion of the extinguisher element received inside the tubular element can be efficiently handled as a single component. The combination can be efficiently incorporated into a mouthpiece using existing apparatus and techniques for filter assembly.

As described above, in the novel mouthpiece arrangement of smoking articles according to the present invention, the extinguisher element is arranged within the mouthpiece between the upstream tubular element and the downstream segment of filter material. The liquid for extinguishing the tobacco rod is securely stored within the reservoir of the extinguisher element prior to activation of the extinguisher element. The sealing means provided over the neck portion of the extinguisher element provides a strong liquid tight seal so that the liquid is retained within the extinguisher element until the consumer chooses to activate the extinguisher element to deliver the liquid to the tobacco rod.

As used herein, the term "activate" refers to an action that causes the sealing means at the open end of the neck portion of the extinguisher element to break so that the liquid from the reservoir can pass out from the extinguisher element, into the tobacco rod. In the context of the present invention, activation is brought about by application of a compressive force to the compressible reservoir in a transverse direction to break the sealing means. To activate the extinguisher element, the outer wall must be squeezed and deformed by the consumer to a sufficient extent that the increase in pressure inside the reservoir causes the sealing means to break. Upon breakage of the sealing means, the liquid is released from the open end of the neck portion of the extinguisher element. Due to the proximity of the open end of the neck portion and the tobacco rod, the liquid is released directly into the tobacco rod and will pass along to the tobacco rod to the burning end, where the liquid will bring about extinguishment of the burning tobacco.

Preferably, the compressive force required to activate the extinguisher element is between about 10 Newtons and about 80 Newtons, more preferably between about 15 Newtons and about 35 Newtons, most preferably between about 20 Newtons and about 30 Newtons. The compressive force may be determined using a universal tensile/compression testing machine equipped with 100 Newton tension load cell, such as Instron or equivalent, operating at about 30 millimetres per minute and at 22 degrees Celsius under 60 percent relative humidity. An example of a manual test machine is the Alluris Type FMI-220C2-Digital Force Gauge 0-200N, available from Alluris GmbH & Co.

The extinguisher element comprises a compressible reservoir which is mounted in the cavity defined between the tubular element and the downstream segment of filter material. The compressible reservoir comprises an outer wall which is preferably formed of a flexible material so that the outer wall will deform without breaking upon application of a compressive force by the consumer. It is advantageous that the outer wall does not break during the activation process, so that the release of the liquid only takes place through the open end of the neck portion and is therefore controlled. The outer wall defines an internal cavity which contains the liquid for extinguishing the tobacco rod.

The outer wall may be formed of any suitable flexible material. Preferably, the outer wall is formed of a polymeric material, such as a polythene based material.

Preferably, the radial thickness of the outer wall is between about 30 microns and about 60 microns.

The compressible reservoir of the extinguisher element may have any suitable outer cross-sectional shape. Preferably, the compressible reservoir is substantially cylindrical and particularly preferably, the compressible reservoir is substantially cylindrical with a substantially circular cross-sectional shape. In certain embodiments, the compressible reservoir has an outer diameter which substantially corresponds to (e.g., is substantially the same as) the outer diameter of the downstream segment of filter material. This may facilitate the combination and wrapping of the extinguisher element with the other filter components. In alternative embodiments, the compressible reservoir has an outer diameter that is smaller than the outer diameter of the downstream segment of filter material. For example, the outer diameter of the compressible reservoir may be between about 0.5 millimetre and about 3 millimetres smaller than the outer diameter of the downstream segment of filter material, more preferably between about 1 millimetre and about 2 millimetres smaller. In such embodiments, the tubular element preferably has an outer diameter which substantially corresponds to the outer diameter of the downstream segment of filter material in order to facilitate the combination and wrapping of the combined extinguisher element and tubular element with the other filter components.

Preferably, the compressible reservoir contains at least about 80 microlitres of the liquid for extinguishing the tobacco rod, more preferably at least about 100 microlitres. Alternatively or in addition, the compressible reservoir preferably contains no more than about 150 microlitres of the liquid for extinguishing the tobacco rod, more preferably no more than about 130 microlitres. This enables a sufficient amount of the liquid to be provided that the liquid can effectively extinguish the burning tobacco rod, whilst ensuring that the extinguisher element does not take up an excessive amount of space within the mouthpiece.

Preferably, the inner cavity of the compressible reservoir is substantially filled by the liquid. Preferably, the volume of air within the inner cavity is less than 5 percent of the total internal volume of the inner cavity. This enables the compressive force applied by the consumer to be effectively transferred to the sealing means in order to break the sealing means and activate the extinguisher element.

The liquid provided in the compressible reservoir may be any liquid that is suitable for extinguishing the burning tobacco rod. Preferably, the liquid is an aqueous liquid comprising at least one of water and polyethylene glycol.

In some embodiments the liquid may comprise at least one flavourant, preferably a hydrophilic flavourant. Suitable flavourants include at least one of decanal, limonene, acetoin, sucrose, sorbitol, ethyl lactate, citric acid, chicory extract, alpha ionone, lactic acid, pyruvic acid, vanilla oleoresin, butyl alcohol, butyric acid, benzyl alcohol, ethyl acetate, nonyl acetate, fenugreek extract, isobutyl alcohol, isobutyric acid, cyclotene, coffee dione, frambinone, 2-3 dimethyl pyrazine, ethyl butyrate, ethyl maltol, ethyl propionate, vanillin, furaneol, isobutyraldehyde, isovaleric acid, maltol, benzaldehyde, dimethyl sulphide, 2 methyl butyric acid, isovaleraldehyde, phenethyl alcohol, phenylacetic acid, heliotropine, valeric acid, valeraldehyde, and combinations thereof.

As described above, the extinguisher element further comprises a neck portion extending from the compressible reservoir towards the tobacco rod. The extinguisher is mounted within the mouthpiece such that the open end of the neck portion is positioned proximate the downstream end of the tobacco rod. The open end of the neck portion may abut the downstream end of the tobacco rod. Alternatively and preferably, the open end is positioned at least about 1 millimetre downstream of the upstream end of the tubular element, more preferably at least about 2 millimetres downstream. This ensures that the open end is sufficiently close to the tobacco rod to release the liquid directly into the tobacco rod upon activation of the extinguisher element, whilst positioning the open end a small distance away from the downstream end of the tubular element to provide protection to the extinguisher element during manufacture.

The neck portion of the extinguisher element is preferably integrally formed with the compressible reservoir. This advantageously enables the extinguisher element to be integrally formed in a single piece.

The diameter of the open end of the neck portion is preferably at least about 2 millimetres, more preferably at least about 2.5 millimetres. Alternatively or in addition, the diameter of the open end of the neck portion is preferably no more than about 4 millimetres, more preferably no more than about 3 millimetres.

The extinguisher element is preferably shaped such that there is a gradual decrease in the outer diameter of the neck portion moving from the compressible reservoir to the open end. This helps to retain the neck portion securely in the tubular element and substantially prevents further movement of the extinguisher element towards the tobacco rod.

An example of a suitable product for use as the extinguisher element in the smoking article articles of the present invention is a BEEM® capsule.

The extinguisher element further comprises sealing means provided over the open end of the neck portion to seal the liquid inside the compressible reservoir until the extinguisher element is activated by the consumer. The sealing means may take any suitable form that enables the sealing means to retain a strong seal before activation and to break upon compression of the compressible reservoir by the consumer. Preferably, the sealing means comprises a frangible cover portion or cap provided over the open end of the neck portion that breaks due to increased pressure when the compressible reservoir is compressed. In alternative embodiments, the sealing means may be in the form of a valve which opens upon application of a compressive force to the compressible reservoir. The sealing means is preferably adapted to break upon the application of a compressive force within the range of activation force indicated above.

In the novel mouthpiece arrangement of the present invention, the neck portion of the extinguisher element is supported in the longitudinal channel of the tubular element. Preferably, the longitudinal channel is provided substantially centrally in the tubular element. Preferably, the longitudinal channel of the tubular element has a substantially round cross-sectional shape with a diameter of between about 2 millimetres and about 4 millimetres.

The diameter of the longitudinal channel may be adapted depending on the diameter of the neck portion of the extinguisher element. Preferably, the diameter of the longitudinal channel is such that the neck portion can be retained in the tubular element by means of a friction fit, without the need for an adhesive. Alternatively, the neck portion of the extinguisher element may be retained within the longitudinal channel of the tubular element by means of a suitable adhesive.

The tubular element may take any suitable form. Preferably, the tubular element is a hollow tube of a filtration material such as cellulose acetate. Alternatively, the tubular element may be a spiral wound paper or cardboard tube, or an extruded tubular element.

Preferably, the resistance to draw of the tubular element, with the neck portion in place within the longitudinal channel is between about 20 millimetres of water gauge and about 50 millimetres of water gauge, more preferably between about 30 millimetres of water gauge and about 40 millimetres of water gauge, most preferably about 35 millimetres of water gauge. Preferably, the tubular element has a length of between about 3 millimetres and about 6 millimetres.

Preferably, the upstream end of the tubular element abuts the downstream end of the tobacco rod such that the liquid from the extinguisher element can be effectively delivered to the tobacco rod upon activation of the extinguisher element.

The mouthpiece of smoking articles according to the present invention further comprises a downstream segment of filter material, which is provided downstream of the extinguisher element. Preferably, the downstream segment of filter material provides the mouth end component of the mouthpiece. Alternatively, one or more additional filter segments may be provided downstream of the downstream segment of filter material.

The downstream segment of filter material preferably abuts the downstream end of the compressible reservoir.

Preferably, the downstream segment of filter material is a plug of a fibrous filter material, such as cellulose acetate tow, polylactide or paper. A filter plasticiser may be sprayed onto the fibrous filtration material in a conventional manner, by spraying it onto the separated fibres. Preferably, the downstream segment of filter material has a length of at least 8 millimetres, more preferably at least 10 millimetres. Alternatively in addition, the downstream segment of filter material preferably has a length of less than 20 millimetres, more preferably less than 16 millimetres.

As described above, the downstream segment of filter material is spaced apart from the tubular element in the longitudinal direction to define the cavity in which the extinguisher element is container. Preferably, the downstream segment of filter material is spaced apart from the tubular element by at least 5 millimetres, more preferably by at least 8 millimetres. Alternatively or in addition, the downstream segment of filter material is preferably spaced apart from the tubular element by less than 15 millimetres, more preferably less than 12 millimetres. The spacing between the downstream segment of filter material and the tubular element corresponds to the length of the cavity in the mouthpiece. The length of the cavity can be adjusted depending on the size of the extinguisher element required to be placed within the mouthpiece.

The mouthpiece of smoking articles according to the present invention may consist only of the tubular element, the extinguisher element and the downstream segment of filter material. Alternatively, the mouthpiece may comprise one or more additional filter components downstream of the downstream segment of filter material.

Preferably, the mouthpiece of smoking articles according to the present invention comprises a plug wrap circumscribing at least the extinguisher element and the tubular element. Preferably, the plug wrap is a combining plug wrap circumscribing all of the mouthpiece components, including the extinguisher element, the tubular element and the downstream segment of filter material. In use, the consumer must apply the compressive force to the extinguisher element through the plug wrap and any other wrappers present on the mouthpiece.

The mouthpiece of smoking articles according to the present invention is preferably connected to the tobacco rod by means of a tipping wrapper. Optionally, the tipping wrapper may be provided with one or more indicia on the outer surface to indicate to the consumer the presence and location of the extinguisher element.

The smoking article preferably has a resistance to draw of between about 50 millimetres of water gauge and about 130 millimetres of water gauge, more preferably between about 70 millimetres of water gauge and about 110 millimetres of water gauge, prior to activation of the extinguisher element.

Smoking articles according to the present invention may be filter cigarettes or any other smoking articles in which the tobacco rod is combusted during use to form smoke.

The mouthpiece of smoking articles according to the present invention may be manufactured using methods according to the present invention, as defined above. In such methods, a tubular element and an extinguisher element as described in detail above in relation to the smoking articles of the invention are provided and the tubular element and the extinguishing element are combined with a segment of filter material such that the reservoir of the extinguishing element is positioned between the tubular element and the segment of filter material. At a given stage during the method, the neck portion of the extinguisher element is inserted into the longitudinal channel of the tubular element. This may occur prior to the combination of the tubular element and the extinguisher element with the segment of filter material. Alternatively, the tubular element, the extinguisher element and the segment of filter material may be arranged longitudinally and then compressed in a longitudinal direction in order to push the neck portion of the extinguisher element into the longitudinal channel of the tubular element. In a final step of the method, the combined tubular element, extinguisher element and segment of filer material are circumscribed with a wrapper to form a mouthpiece.

Preferably, a plurality of mouthpieces for the smoking articles according to the invention are formed in a continuous manufacturing method. In such a method, a plurality of tubular elements are provided and for each tubular element, a pair of extinguisher elements is provided. One extinguisher element is arranged on each side of the tubular element with the neck portion thereof directed towards the longitudinal channel of the tubular element. This provides a combination of one tubular element with a pair of extinguisher elements. A segment of filter material is provided between each of these combinations to form a continuous longitudinal arrangement of the mouthpiece components. At a given stage during the method, the neck portion of each extinguisher element is inserted into the longitudinal channel of the respective tubular element. As described above, this insertion of the neck portion into the longitudinal channel may take place prior to the combination of the tubular elements and the extinguisher elements with the segments of filter material, or it may take place once all of the mouthpiece components have been longitudinally arranged. In a final step of the method, the continuous longitudinal arrangement of mouthpiece components is cut at a position midway along each segment of filter material and at a position midway along each tubular element to form a plurality of mouthpieces.

In this continuous method, double length tubular elements and double length segments of filter material are provided, which have length that is twice that of the tubular element and the downstream segment of filter material in the final mouthpiece. This is because both the tubular element and the segment of filter material are cut in half during the manufacturing method, as described above.

The neck portion of each extinguisher element is preferably inserted into the longitudinal channel of the double length tubular element such that the open end of the extinguisher element is at least 1 millimetre away from the line along which the double length tubular element is cut during the manufacturing method, more preferably at least 2 millimetres away. This minimises the risk of the extinguisher element being damaged during the cutting step.

Figure 2:
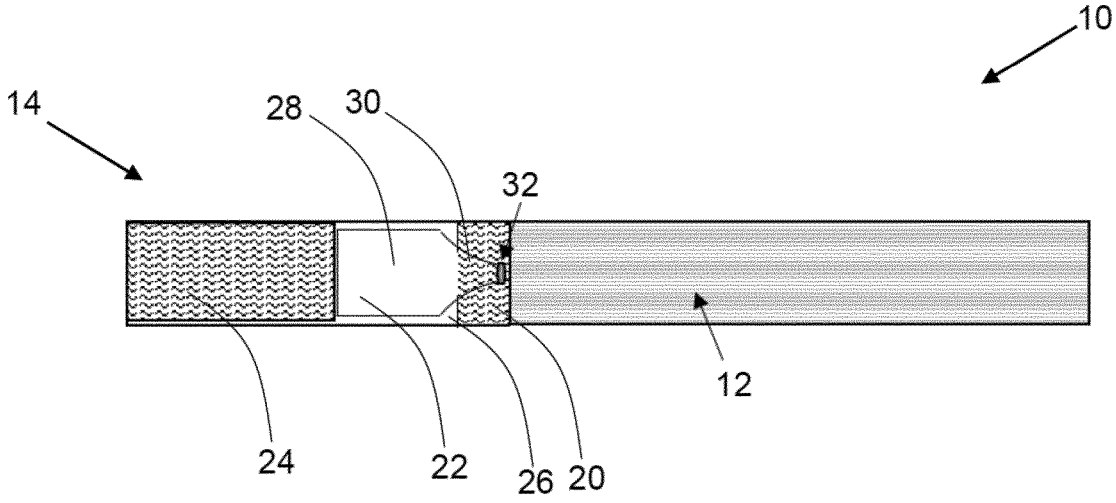

The invention will now be further described, by way of example only, with reference to the accompanying drawings in which:

FIG. 1 shows a perspective view of a smoking article according to the present invention; and FIG. 2 shows a longitudinal cross-sectional view of the smoking article of FIG. 1.

FIGS. 1 and 2 illustrate a smoking article 10 in accordance with the present invention. The smoking article 10 comprises a wrapped tobacco rod 12 of tobacco cut filler which is attached at one end to an axially aligned mouthpiece 14. A band of tipping paper circumscribes the mouthpiece 14 and a portion of the wrapped tobacco rod 12 to join together the two components of the smoking article 10.

As shown in FIG. 2, the mouthpiece 14 comprises a tubular element 20, an extinguisher element 22 and a downstream segment of filter material 24. The tubular element 20 is provided at the upstream end of the mouthpiece 14, with the upstream end of the tubular element 20 abutting the downstream end of the tobacco rod 12. The tubular element 20 is a hollow acetate tube having a central longitudinal channel.

The downstream segment of filter material 24 is a segment of cellulose acetate tow which is provided at the mouth end of the mouthpiece 14. The downstream segment of filter material 24 is spaced apart from the tubular element 20 in the longitudinal direction to define a cavity 26 within the mouthpiece 14.

The extinguisher element 22 is provided in the cavity 26 between the tubular element 20 and the downstream segment of filter material 24. The extinguisher element 22 comprises a compressible reservoir 28 and an integral neck portion 30 extending upstream from the compressible reservoir 28. The compressible reservoir 28 is substantially cylindrical and is formed by a flexible outer wall defining an inner cavity which contains a liquid for extinguishing the tobacco rod after use. As shown in FIG. 2, the neck portion 30 is mounted in the longitudinal channel of the tubular element 20. The neck portion 30 has an open end at the upstream end, which is sealed in a liquid tight manner by a frangible cover portion 32. The diameter of the neck portion 30 decreases between the compressible reservoir 28 and the open end.

At the end of smoking, the consumer may apply a transverse compressive force to the compressible reservoir 28 to activate the extinguisher element 22 and bring about release of the liquid in order to extinguish the burning tobacco rod 12. The compressive force applied to the compressible reservoir 28 causes deformation of the outer wall and an increased pressure within the cavity of the compressible reservoir 28. At a certain level of compressive force, the increased pressure within the cavity of the compressible reservoir 28 causes the frangible cover portion 32 over the neck portion 30 of the extinguisher element 22 to break, thereby activating the extinguisher element. The breakage of the frangible cover portion 32 allows the liquid within the compressible reservoir to pass out from the cavity in the compressible reservoir 28 through the open end of the neck portion 30. The liquid is released directly into the tobacco rod 12 and passes along the tobacco rod 12 until it reaches the burning end, where it causes extinguishment of the tobacco rod.

The invention claimed is:

1. A mouthpiece for a smoking article, the mouthpiece comprising:

a tubular element defining a longitudinal channel, wherein the tubular element is provided at an upstream end of the mouthpiece;

a downstream segment of filter material, wherein the downstream segment of filter material is downstream of the tubular element and spaced apart from the tubular element to define a cavity between the tubular element and the downstream segment of filter material; and an extinguisher element comprising:

a compressible reservoir provided in the cavity between the tubular element and the downstream segment of filter material, the compressible reservoir containing a liquid;

a neck portion extending in a longitudinal direction upstream from the reservoir and having an open end, wherein the neck portion is received in the longitudinal channel of the tubular element such that the open end is proximate the downstream end of the tobacco rod; and a seal provided over the open end of the neck portion, wherein upon compression of the reservoir during use, the seal is broken and the liquid from the reservoir is releasable through the neck portion and out of the upstream end of the mouthpiece, wherein the compressible reservoir has an outer diameter which is substantially the same as an outer diameter of the downstream segment of filter material.

2. A smoking article comprising a tobacco rod and a mouthpiece secured to a downstream end of the tobacco rod, the mouthpiece comprising:

a tubular element defining a longitudinal channel, wherein the tubular element is provided adjacent the downstream end of the tobacco rod;

a downstream segment of filter material, wherein the downstream segment of filter material is downstream of the tubular element and spaced apart from the tubular element to define a cavity between the tubular element and the downstream segment of filter material; and an extinguisher element comprising:

a compressible reservoir provided in the cavity between the tubular element and the downstream segment of filter material, the compressible reservoir containing a liquid;

a neck portion extending in a longitudinal direction upstream from the reservoir and having an open end, wherein the neck portion is received in the longitudinal channel of the tubular element such that the open end is proximate the downstream end of the tobacco rod; and a seal provided over the open end of the neck portion, wherein upon compression of the reservoir during use, the seal is broken and the liquid from the reservoir is releasable through the neck portion directly into the tobacco rod, wherein the compressible reservoir has an outer diameter which is substantially the same as an outer diameter of the downstream segment of filter material.

3. The smoking article according to claim 2 wherein the open end of the neck portion of the extinguisher element is positioned at least 1 mm downstream of an upstream end of the tubular element.

4. The smoking article according to claim 2 wherein the tubular element is a hollow tube of cellulose acetate.

5. The smoking article according to claim 2 wherein the length of the tubular element is between 3 mm and 5 mm.

6. The smoking article according to claim 2 wherein the seal is a frangible cover portion which covers the open end of the neck portion and which breaks upon compression of the reservoir such that the liquid from the reservoir is releasable through the open end of the neck portion.

7. The smoking article according to claim 2 wherein the neck portion and the reservoir are integrally formed.

8. The smoking article according to claim 2 wherein the neck portion at the open end has a diameter which is between 2 mm and 4 mm.

9. The smoking article according to claim 2 wherein the reservoir is formed of a polymeric material.

10. The smoking article according to claim 2 wherein the reservoir is formed of a material having a thickness of between 30 microns and 60 microns.

11. The smoking article according to claim 2 wherein the liquid in the reservoir of the extinguisher element comprises water and one or more hydrophilic flavourant additives.

12. The smoking article according to claim 2 wherein a downstream end of the reservoir abuts the downstream segment of filter material.

13. A method of manufacturing a mouthpiece for a smoking article, the method comprising the steps of:

providing a tubular element having a longitudinal channel;

providing an extinguishing element comprising a compressible reservoir; a neck portion extending from the reservoir and having an open end; and a seal provided over the open end of the neck portion;

inserting the neck portion of the extinguishing element into the longitudinal channel of the tubular element;

combining the tubular element and the extinguishing element with a segment of filter material such that the reservoir of the extinguishing element is positioned between the tubular element and the segment of filter material and such that a compressible reservoir outer diameter is substantially the same as a filter material downstream segment outer diameter; and circumscribing the tubular element, the extinguishing element and the segment of filter material with a wrapper to form the mouthpiece.

14. A method of producing the mouthpiece of the smoking article according to claim 2, the method comprising the steps of:

providing a plurality of tubular elements each having the longitudinal channel;

for each tubular element, providing a pair of extinguishing elements and arranging one extinguishing element on each side of the tubular element with the neck portion of the respective extinguishing elements directed towards the longitudinal channel of the tubular element;

providing the segment of filter material between each combination of the tubular element and pair of extinguishing elements to form a continuous longitudinal arrangement;

inserting the neck portion of each extinguishing element into the longitudinal channel of the respective tubular element; and cutting the continuous longitudinal arrangement at a position midway along each segment of filter material and at a position midway along each tubular element to form a plurality of mouthpieces.

* * * * *